US005125151A

United States Patent [19]

Smart

[11] Patent Number: 5,125,151

[45] Date of Patent: Jun. 30, 1992

[54] RIVET SETTING TOOL

[75] Inventor: Charles F. Smart, Danbury, Conn.

[73] Assignee: Emhart Inc., Newark, Del.

[21] Appl. No.: 564,198

[22] Filed: Aug. 8, 1990

[51] Int. Cl.[5] ..... B23P 21/00; B23Q 15/00

[52] U.S. Cl. ..... 29/706; 29/720; 173/20; 227/2

[58] Field of Search ..... 29/706, 708, 720; 227/2; 173/20

[56] References Cited

U.S. PATENT DOCUMENTS

| | | | |
|---|---|---|---|
| 3,739,448 | 6/1973 | Garner | 29/706 |
| 3,825,912 | 7/1974 | Wiese et al. | 173/20 |
| 4,787,136 | 11/1988 | Majic | 29/720 X |
| 4,901,431 | 2/1990 | Gast | 227/2 X |

FOREIGN PATENT DOCUMENTS

| | | | |
|---|---|---|---|
| 0138565 | 4/1985 | European Pat. Off. | 227/2 |
| 3405224 | 8/1984 | Fed. Rep. of Germany | 227/2 |
| 0765459 | 9/1980 | U.S.S.R. | 173/20 |

*Primary Examiner*—Timothy V. Eley
*Assistant Examiner*—C. Richard Martin
*Attorney, Agent, or Firm*—Spencer T. Smith

[57] ABSTRACT

The system accordingly strictly accounts for all rivets and prevents a rivet from being removed for any reason and not accounted for. This assures that no free rivet will find itself within the workpiece being riveted.

5 Claims, 3 Drawing Sheets

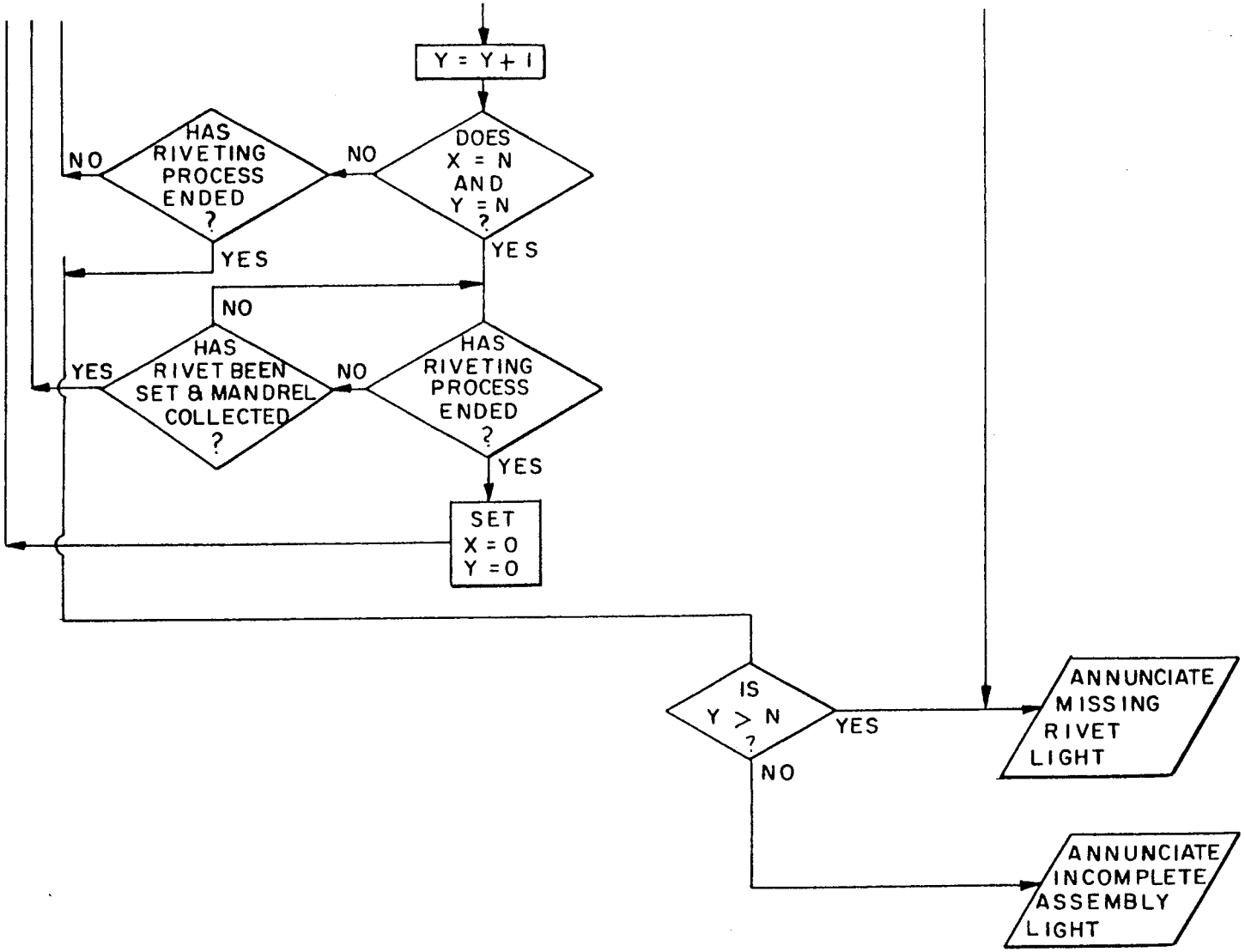
Y = Y + 1
DOES X = N AND Y = N ?
YES
NO
HAS RIVETING PROCESS ENDED ?
NO
YES
HAS RIVETING PROCESS ENDED ?
YES
NO
HAS RIVET BEEN SET & MANDREL COLLECTED ?
NO
YES
SET X = 0 Y = 0
IS Y > N ?
YES
NO
ANNUNCIATE MISSING RIVET LIGHT
ANNUNCIATE INCOMPLETE ASSEMBLY LIGHT

RIVET SETTING TOOL

The present invention relates to automatic rivet setting tools which have a loading device for feeding rivets one at a time to the nose of the rivet tool.

Air bag assemblies are conventionally riveted in place and during this procedure a rivet that is not successfully fed to the rivet tool can fall into the air bag assembly where it could remain. Deployment of the air bag might convert this contained rivet into a projectile. It is accordingly important that no stray rivet be left in this assembly.

It is an object of the present invention to that all stray rivets are accounted for so that a stray rivet will not wind up a part of the object being riveted.

It is also an object of the present invention to insure that the correct number of rivets are used in the assembly.

Other objects and advantages of the present invention will become apparent from the following portion of the specification and from the accompanying drawings, which illustrate, in accordance with the mandate of the patent statutes, a presently preferred embodiment of the invention.

Referring to the drawings.

Figure 1:
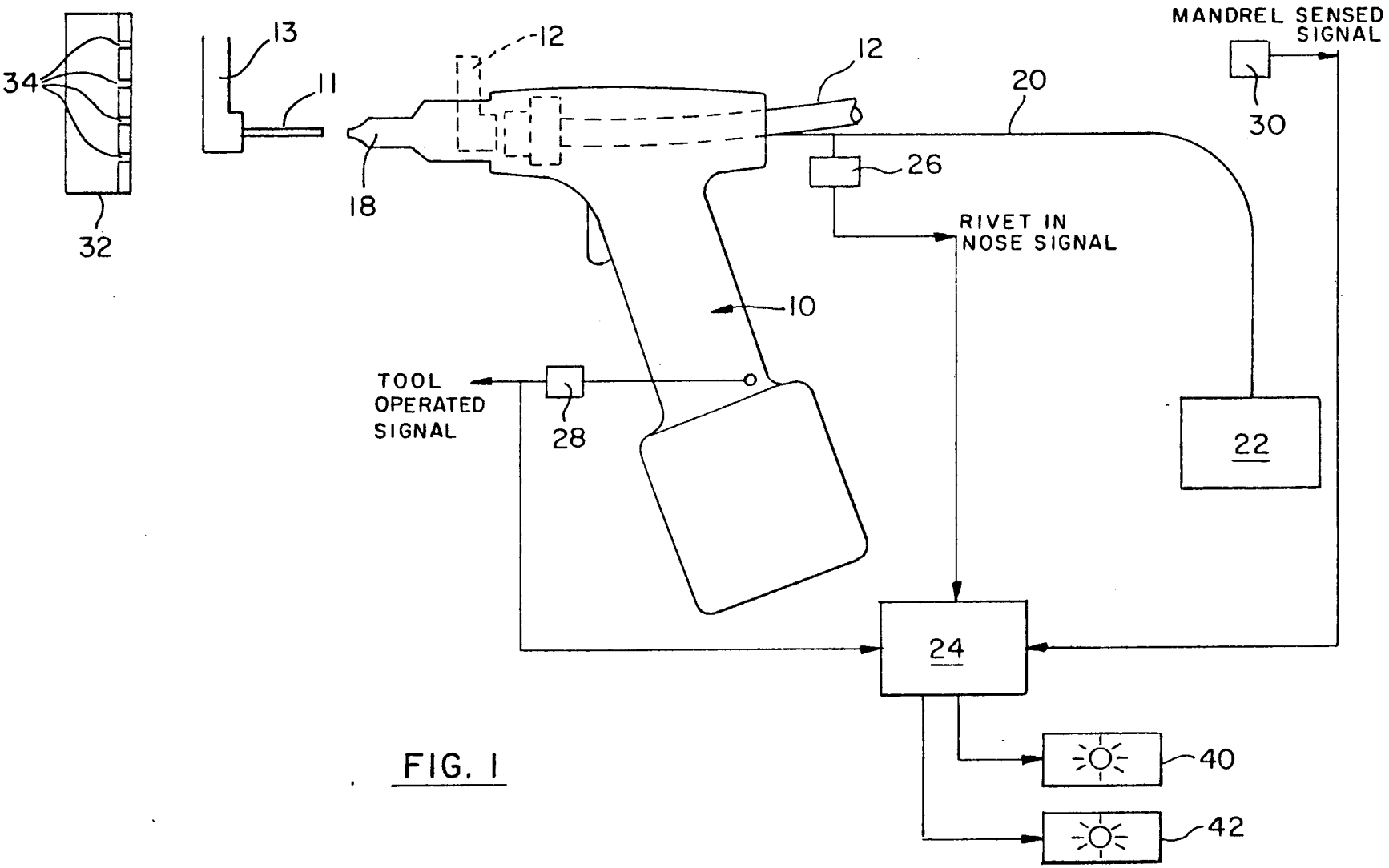
FIG. 1 is an elevational view of a rivet setting tool.

In an automatic rivet setting tool 10 a rivet 11 is fed through a supply tube 12 to a loader device 13. When the rivet tool sets a rivet the loader device 13 moves from the position illustrated in phantom to the illustrated position to locate the next rivet in front of the nose 18 of the rivet tool and the rivet is blown into the nose. When the rivet is set, the spent mandrel passes through the collection tube 20 into a collection box 22. Certain signals will be generated and supplied to the tool control 24. A vacuum switch 26 senses the presence of a rivet in the nose 18 and issues a Rivet In Nose Signal, a similar switch 28 senses tool operation and issues a Tool Operated Signal and a proximity switch 30 senses mandrel passage through the collection tube and issues a Mandrel Collected Signal.

The rivet setting tool 10 will be used to set a predetermined number (N) of rivets in a workpiece 32. In the illustrated workpiece four blind holes 34 are shown to schematically represent rivet locations to be riveted during the processing of the workpiece but any number of rivets may be set during the processing of a workpiece.

Figure 2:
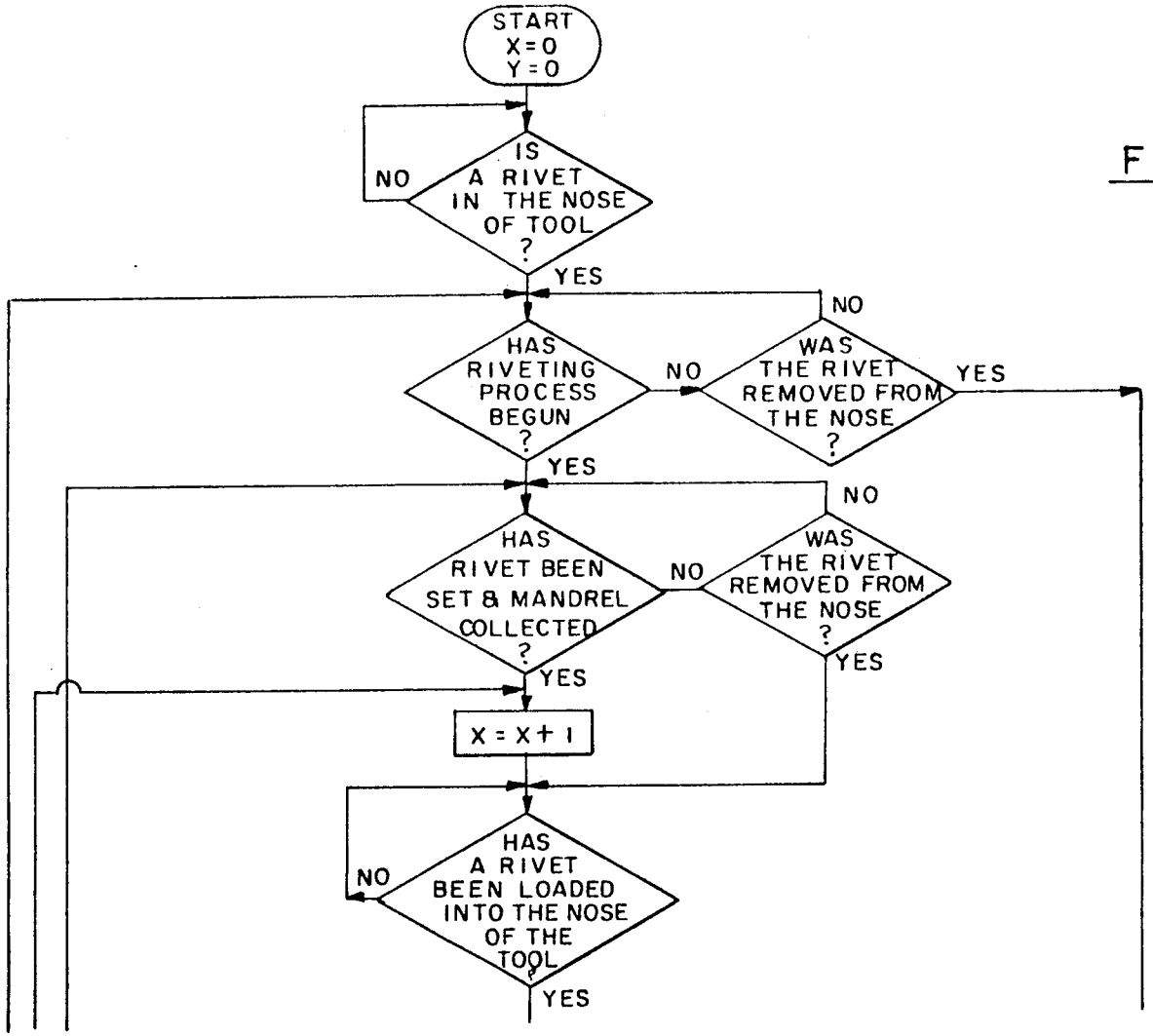
FIG. 2 is a logic diagram or flow chart illustrating the operation of the rivet setting tool shown in FIG. 1.

FIG. 2 illustrates the flow chart for tool operation. "X" represents the number of rivets set in a workpiece and "Y" represents the number of rivets supplied to the tool nose. At the start of a rivet setting process X and Y are set at O and a rivet is in the nose of the tool. When the rivet setting process is started on a given workpiece the control monitors the presence of the rivet in the nose. Should the rivet be removed from the nose before it is set (the Rivet In Nose Signal disappears prior to receipt of a Tool Operated Signal) the control will annunciate the missing rivet light 40 and the system will be disabled. With the rivet in the nose the tool can be operated (a Tool Operated Signal will be generated) and the spent mandrel will be sensed by the proximity switch 30 (a Mandrel Collected Signal will issue). "X" will then be reset as 1 and the next rivet will be loaded into the nose resetting "Y" also to 1. Assuming only one rivet is to be set in the workpiece (N=1), the cycle would be completed. Since X and Y are both one and the cycle is complete, X and Y would be reset to 0. Where N is four for example, as illustrated with one rivet having been set and one rivet in the nose, X and Y do not equal N and the system loops back to detect the setting of the next three rivets and the supplying of the next three rivets to the nose. Then with X and Y being four and the cycle completed, X and Y would be reset to 0.

Should the cycle be started and a rivet be removed from the nose, the cycle will be disabled until another rivet is supplied to the nose. Now however, Y will be greater than X and when the cycle is completed (the correct number of rivets have been set) Y will be higher than N and the missing rivet light will be annunciated indicating that a rivet has not been accounted for. The system will also be disabled until the missing rivet is accounted for.

When the cycle is complete, if X and Y are not equal to the desired number of set rivets and if Y is not larger than that number, X will be lower than the number of rivets that should have been set and accordingly, the incomplete assembly light will be annunciated indicating that one or more rivets are missing from the assembly. The system will also be disabled.

I claim:

1. A blind rivet setting tool comprising a nose into which a single blind rivet is fed for setting prior to delivery of the next rivet to the nose, means for defining a riveting process during which a selected number of rivets will be sequentially set by the tool, means for counting the number of rivets set by said rivet setting tool during the defined riveting process, means for counting the number of rivets received by said nose during the defined riveting process, means for comparing the count of said counting means following the completion of said defined riveting process with said selected number of rivets to be sequentially set during the riveting process defined by said defining means and, means for alerting the operator whenever the defined riveting process is completed but the number of rivets supplied to the nose exceeds said selected number of rivets set during the defined riveting process means for informing the operator whenever the defined riveting process is complete but the number of rivets actually set is less than the number of rivets to be set during the defined riveting process.

2. A rivet setting tool according to claim 1, wherein said alerting means comprises a warning light.

3. A rivet setting tool according to claim 1, wherein said alerting means further comprises means for disabling the rivet setting tool.

4. A rivet setting tool according to claim 1, wherein said informing means comprises a warning light.

5. A rivet setting tool according to claim 1, wherein said informing means further comprises means for disabling the rivet setting tool.

* * * * *